United States Patent [19]

Cason, Sr. et al.

[11] 4,066,871

[45] Jan. 3, 1978

[54] VOTING SYSTEM

[76] Inventors: Charles M. Cason, Sr., 700 Watts Drive, Huntsville, Ala. 35801; Charles M. Cason, III, 1207 Toney Drive, Huntsville, Ala. 35802

[21] Appl. No.: 742,873

[22] Filed: Nov. 18, 1976

[51] Int. Cl.[2] ..... G07C 13/00

[52] U.S. Cl. ..... 235/54 F

[58] Field of Search ..... 235/50 R, 50 A, 50 B, 235/51, 54 E, 54 F, 55 R, 55 E, 56

[56] References Cited

U.S. PATENT DOCUMENTS

| | | | |
|---|---|---|---|
| 881,821 | 3/1908 | Newcomb | 235/51 |
| 882,160 | 3/1908 | Newcomb | 235/51 |
| 1,141,075 | 5/1915 | Rugh | 235/54 F |
| 2,150,256 | 3/1939 | Warren | 235/56 |

*Primary Examiner*—Lawrence R. Franklin
*Attorney, Agent, or Firm*—C. A. Phillips

[57] ABSTRACT

An electronic voting system in which votes are manually entered by a voter on a voting board by means of sliding indicators. The board is then momentarily placed in a separate and discrete vote processor which optically reads instances when an indicator has been moved, and after verification of legal selections, registers the votes cast.

4 Claims, 12 Drawing Figures

VOTING SYSTEM

BACKGROUND OF THE INVENTION

1. Field of the Invention

This invention relates to voting systems, and particularly to an electro-mechanical voting system which is inexpensive to build and operate and wherein the possibility of fraud is eliminated.

2. General Description of the Prior Art

For several years efforts have been underway to substitute electronic voting system for purely mechanical ones because of the higher cost of purchase, maintenance, and operation of the latter. In accordance with this goal, at least one system has been developed and is in use in which voters are given a card upon which small punched holes are made to register a vote, and the cards are then taken by an election official and placed in a computer which reads the cards and records the results. In another voting system, a voter marks a substantially standard type of paper ballot, and the ballot is electronically read. Neither of these systems has proven to be satisfactory inasmuch as there is re-introduced paper (or cardboard) ballots which can be altered, thrown away, or additional ones introduced by a crooked election official just as was the case before mechanical voting machines were introduced. Further, and the most significant disadvantage with both of these systems is that the accuracy of reading a ballot depends upon voters physically effecting a ballot in a sufficiently uniform manner to meet the criteria of the electronic reader, a condition that is not highly reliable.

Another proposed solution to the problem has been to simply convert or add electrical switches to a voting keyboard connected to a computer terminal. As far as is known, this type of system has not been found acceptable, one reason being that it requires a computer terminal for each keyboard, increasing costs to a point where little or no advantage is reflected over mechanical voting machines.

It is the object of this invention to overcome the aforesaid and other disadvantages of existing and proposed voting machines and to provide an improved voting system which is less costly to purchase, operate, maintain, and store than previous voting equipment, and which is, most importantly, fraudproof.

SUMMARY OF THE INVENTION

In accordance with the invention, a voter would enter votes on a small, hand-held ballot or voting board, entering votes by means of effecting a uniform change on the board, such as by moving a slider uncovering an "X" beside the name of a candidate or a proposition, for example, an amendment. When all votes have been entered to the satisfaction of the voter, the voting board is immediately inserted into a vote accumulator, and the mechanical state of the vote indicators is ascertained by optical or other means. Electrical outputs of votes cast are compared with a valid combination of votes for that election, and if proper, the votes are electrically recorded and counted. In the event of an improper vote, such as where too many ballots are cast in a particular contest, a signal would inform the voter of this, and the voter would have an opportunity to correct his ballot before it is registered.

DETAILED DESCRIPTION OF THE DRAWINGS

Figure 1:
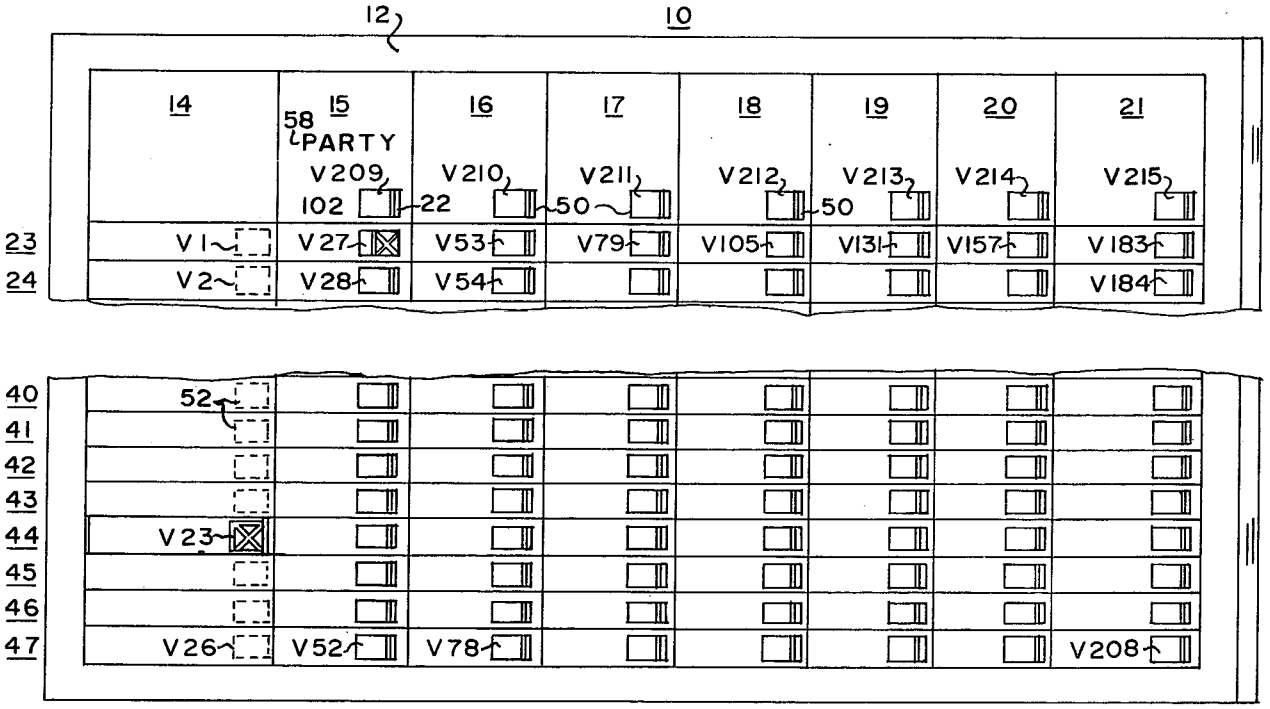
FIG. 1 is a top view of a vote indicator board as contemplated by this invention.
Figure 2:
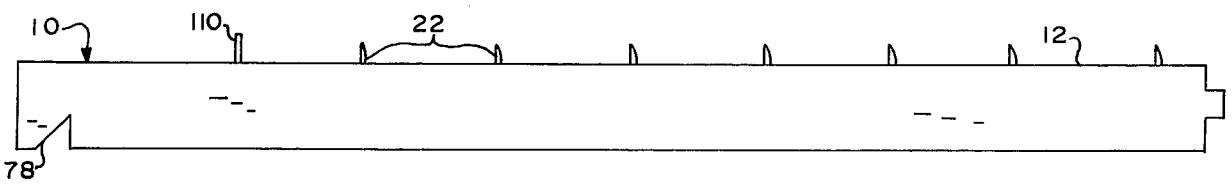
FIG. 2 is a side edge view of a vote indicator board and a portion of a mechanism employed to handle write-in ballots.
Figure 3:
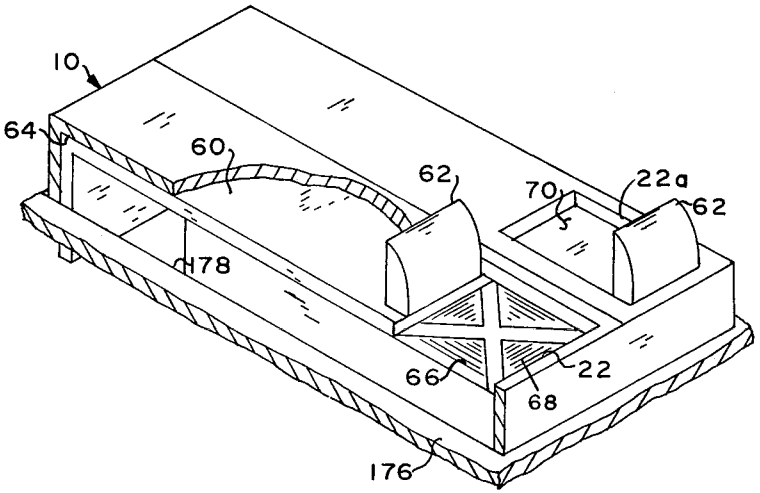
FIG. 3 is a pictorial view of two of the vote indicators of the vote indicating board.
Figure 8:
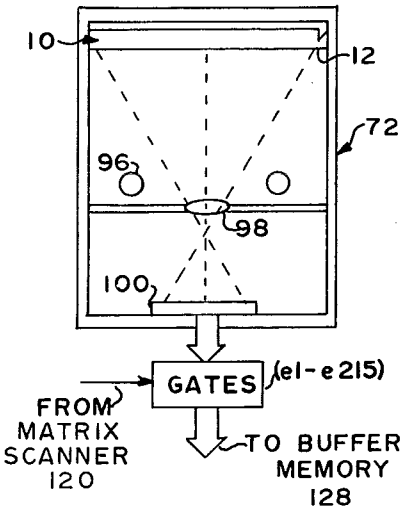
FIG. 8 is a schematic illustration of an optical reader for reading votes from a vote indicating board.
Figure 9:
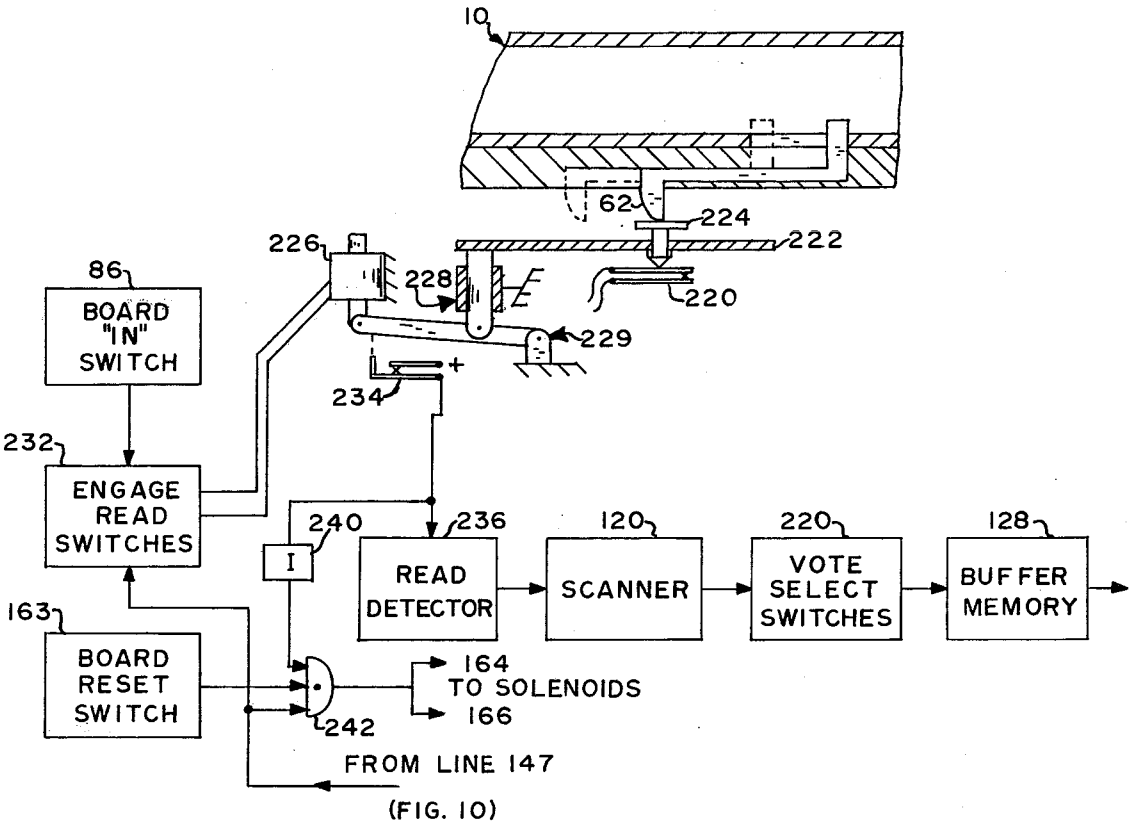
FIG. 9 is a sectional view along lines 7—7 of FIG. 5, and additionally illustrating schematically a modification of the invention in which the voting indicators are read by mechanically operated switches.

Referring initially to FIGS. 1 and 2, there is illustrated a vote indicator board 10 as contemplated by this invention. It would be constructed of a size, for example, 1 inch by 8½ inches by 15 inches, accommodating, on its face 12, 26 rows and seven or less columns. Typically, first column 14 would be used to identify the offices or propositions being voted on, and the succeeding columns 15–21 would be used to list candidates' names or propositions and to house vote indicators 22, there being one each of these indicators for each of rows 23–47 of each column beyond first column 14. Additionally, there would be provided straight ticket indicators 50 at the top of each column under the party or other column designations 58. As shown in FIG. 3, a vote indicator 22 contains a sliding plate 60 operated by a small knob 62 by which plate 60 is slid left and right in housing 64 on board 10 by a voter to cover or uncover "X" mark 66. "X" mark 66 (or the space 68 around it) is of a distinctive pattern or color from the outer top surface 70 of sliding plate 60, enabling it to appear distinctive to a voter so that he may clearly see his choices, and to enable a substantial contrast between a vote and a non-vote condition to achieve accurate reading of the vote by optical reader 72. (FIG. 8). It is to be appreciated that in contrast to marking a paper ballot, which when once marked stays marked, a voter may change his mind after moving one of sliding plates 60 to cast a vote for one candidate and move that sliding plate back to a closed or "no vote" position and vote for a second candidate. His selections are not final until the board is placed in console 74 (FIG. 5) for reading by optical reader 72 (FIG. 8) or switches 220, as shown in FIG. 9.

Figure 6:
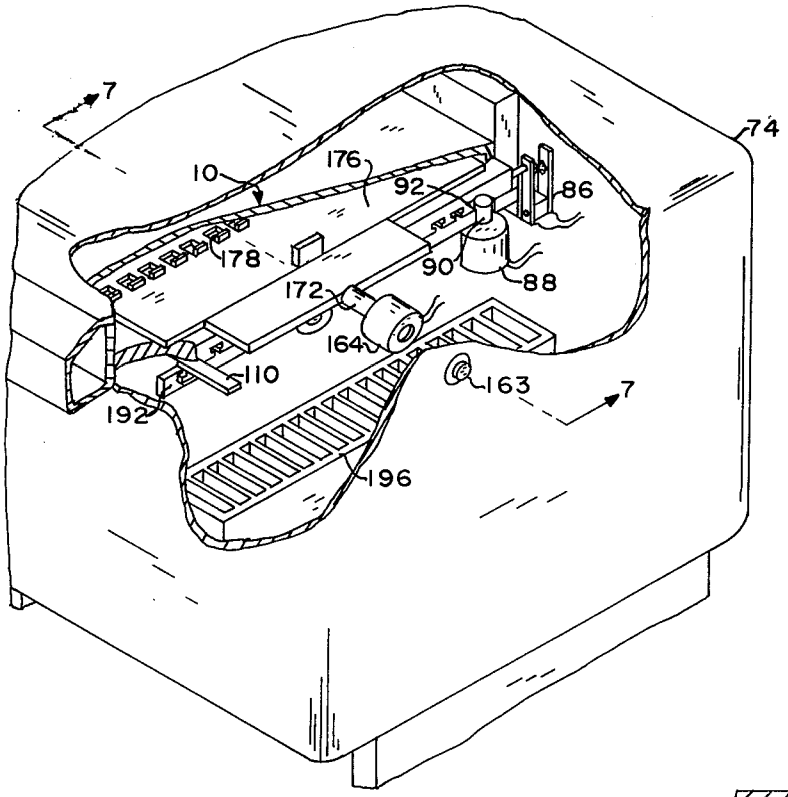
FIG. 6 is a pictorial view, partially broken away, of the voting console shown in FIG. 5 together with a voting board, and illustrating a portion of the system for resetting the voting board and method of handling write-in ballots.
Figure 5:
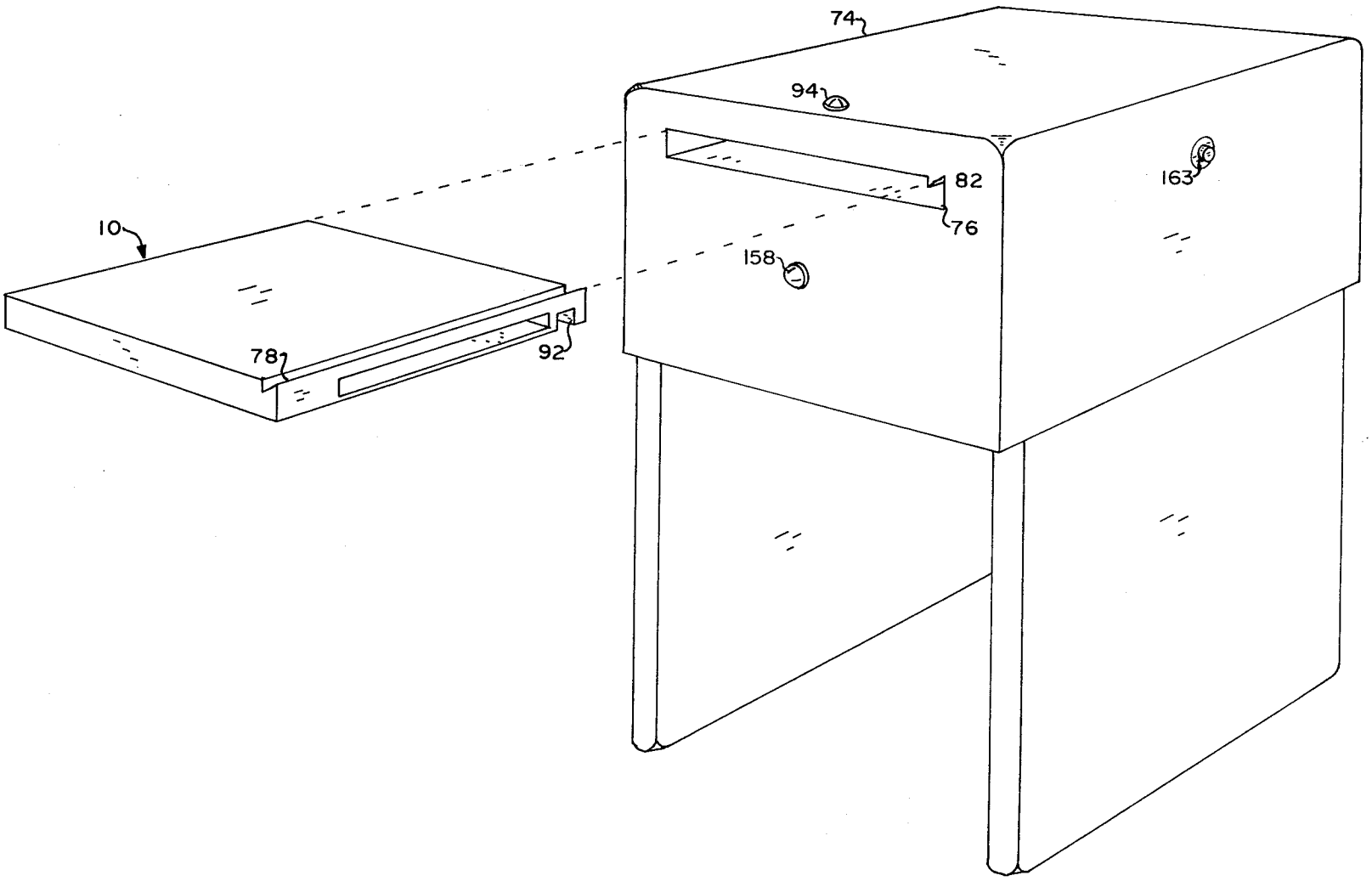
FIG. 5 is a pictorial view illustrating the insertion of a voting board in a voting console.

Referring to FIGS. 5 and 6, a voter indicator board 10 is read by inserting it in slot 76 of console 74, there being locking groove 78 in voting board 10 and complementary mating surface 82 in console 74 in order to precisely position voting board 10 in console 74. When voting board 10 is fully inserted, it operates "board in" switch 86 which operates solenoid 88 to operate armature 90 into a slot 92 in board 10, locking board 10 in place, indicating by a light 94 (FIG. 5) to a voter and election officials that the board is properly positioned and a ballot is being processed. Switch 86 also initiates the electrical and electronic portions of the system, including optical reader 72 (FIG. 8).

Figure 4:
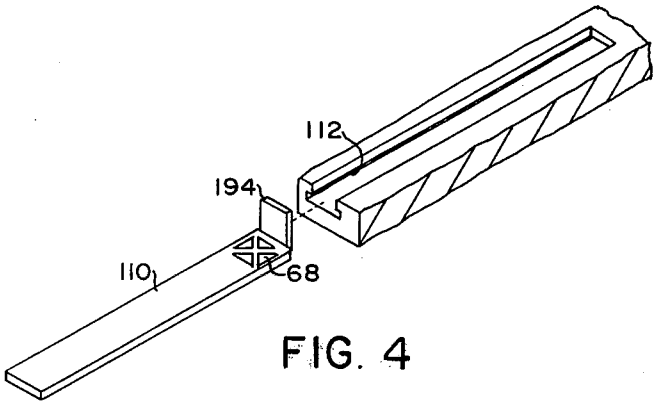
FIG. 4 is a pictorial view illustrating a receptacle in the voting board for receiving write-in ballots.

Referring to FIG. 8, optical reader 72 contains lights 96 which illuminate board 10. Lens 98 projects the face 12 of board 10 onto a matrix 100 of photodiodes or other form of light sensors, there being at least one photodiode positioned to receive light from each position on the face of the indicator board wherein a vote indicating area 102 (FIG. 1) may appear. This includes in addition to the vote indicators for each voting position in columns 15–21 and straight ticket vote indicators 50 regions 52 in column 14 wherein a write-in ballot 110 (FIG. 4) may be inserted, having the same readable surface 68 (FIG. 4) as one of the other vote indicating areas illustrated in FIG. 3.

As an alternate system to that employing a matrix of photodiodes, an X-Y oscillographic type of scanning may be used wherein vertical and horizontal scanning mirrors would be serially arranged in a single light path and varied in angle to scan each of the vote indicator areas or positions on the vote indicator board. With such a system, only a single photodiode or other type of photosensor is required.

While the indicating region around the "X" of each vote indicator is shown as being of a dark color, an opposite contrast may be employed. Further, where it appears necessary to further improve the efficiency of the reading process, the vote indicating areas may be specially coated, as with phosphorus, to effect radiation in a relatively narrow band of wavelengths, and a coordinate optical filter would be used over the light sensing element or elements. Or, by employing a type of light sensing element particularly responsive to the wavelength of emission from the phosphorus, the filter could be omitted. The light source in such a system would provide a wavelength of light particularly adapted to stimulate the radiation from the phosphorus which may be a different wavelength than that of the light source.

Referring again to FIG. 8, we will assume that there is a photodiode positioned to observe, via lens 98, each one of the indicating regions 102 (FIG. 1) on board 10. Each photodiode is encoded with a discrete number as an address. For example, we will assume that there is a total of 215 addresses, and a like number of photodiodes, one for each of 26 candidates for each of the seven columns, one for each of seven straight ticket voting positions 50, and 26 write-in indicator positions 52. We will further assume by way of example that the column of write-in indicator positions, from top to bottom, are encoded with the numerals V1-V26 and that indicators in the following seven columns, from top to bottom, are similarly coded, sequentially, with first column 15 positions being coded V27-V52, volumn 16 candidate positions coded V53-V78, and so on, with the seventh column 21 candidate positions being coded V183-V208. Finally, the straight ticket vote indicators, we will assume, are encoded, from left to right, V209-V215.

Where an X-Y oscillographic type scanning is employed for a given "Y" position, for example, row 44, an "X" mirror would scan each column position for that row which, in terms of addresses, may be regarded as X44, Y14, then X44, Y15, and so on, to address X44, Y21. Next, the "Y" mirror would step to row 45 and repeat the procedure. This system, of course, requires only one photodiode instead of 215. Alternately, a photodiode might be used to cover each of the "X" addresses and use only a "Y" mirror to take care of the vertical scan of all addresses.

To examine the operation of the system of the invention thus far described, we will assume that a voter has operated the indicators on board 10 to vote, indicating a straight ticket vote under the party of column 15 by operating indicator V209 and a write-in ballot in the twenty-third row (FIG. 1) by inserting a paper insert 110 (FIG. 4) in a receptacle 112 identifying the office being voted for. Under the system of this invention, a single vote in any one of the rows, in addition to a straight ticket vote, would simply reject the straight ticket candidate for that office. However, if there is a third vote in a given row, there would be an obvious ambiguity as to the voter's intent. If there is no straight ticket vote, then any two votes in a given row would indicate an error. These conditions are dealt with in the following description of operation.

Figure 10:
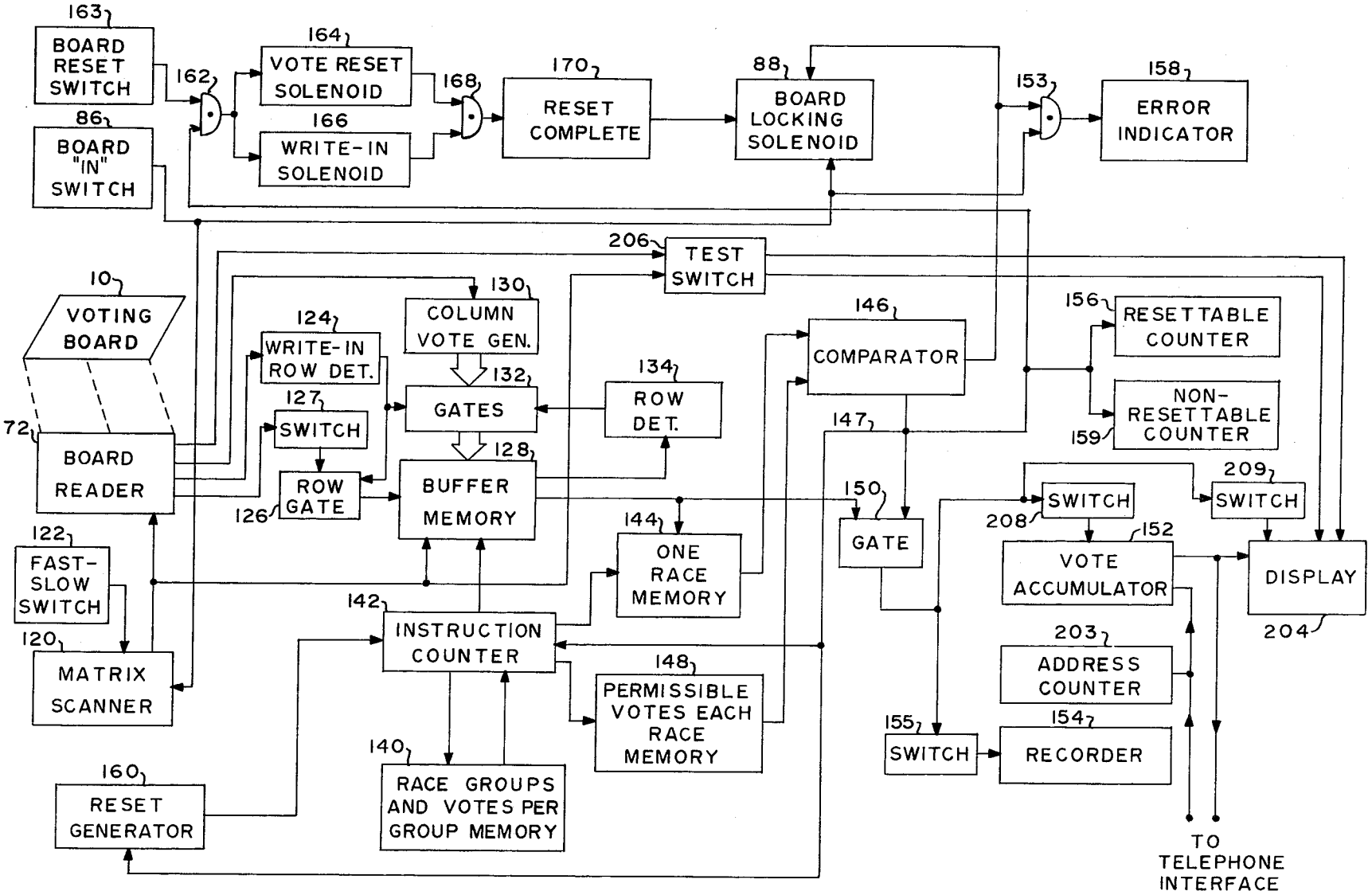
FIG. 10 is an electrical schematic illustration of the system of this invention.

Upon the full insertion of voting board 10 into console 74, "board in" or initiate switch 86 is operated to energize board locking solenoid 88, locking board 10 in place and electrically initiating operation of the electronic system of the invention as shown in FIG. 10. Thus, matrix scanner 120, an address counter, is operated on with fast-slow scan switch 122 in a fast mode for normal operation, matrix scanner 120 commences providing numerical coded outputs E1-E215, which operate like coded gates connected to the outputs of photodiodes of optical reader 72 viewing like numerically coded indicators on board 10. First, with counts 1–26 occurring in this sequence, optical reader 72 scans the write-in column of indicator positions V1-V26, and as further stated, we will assume that there is a write-in ballot or tab 110 (FIG. 4) appropriately marked and placed in receptacle 112 in board 10 to provide at an indicator position V23 a particular write-in vote. Accordingly, an output from optical reader 72 of the row in question is fed to write-in row detector 124. It then provides a blocking output to a row gate of row gates 126 corresponding to the row in which the write-in occurs. A row gate then operates to block any vote output of reader 72 through switch 127 to buffer memory 128 which is otherwise indicated by a voter in that row. This prevents double voting at such time as the optical reader is scanned through the balance of the voting board, as will be further explained.

Assuming that a response from reader 72 provides a 1-volt output (it may be another value) responsive to the appearance of a positive vote state from one of the vote indicators of board 10, then column vote generator 130 would provide such an output which would be switched through a discrete switch, one for each of vote indicators V209-V215, through row gates 126 to a memory location in buffer memory 128 for each row of the selected column not blocked by row gates 126. Next, matrix scanner 120 (FIG. 10) commences general scanning of the board, scanning, for example, in the numerical sequence described to accomplish column scanning. Alternately, scanning could be by rows.

Whenever a vote indicator indicates a vote, a signal is passed through row gate 126 to buffer memory 128, except in a situation where a voter has entered a write-in ballot as described above, and in which case the row gate for that row would block a vote for a second candidate in that row. Buffer memory 128, also controlled by matrix scanner 130, internally routes the votes in memory 128 to like arranged memory locations to that of the ballot and optical reader 72. Buffer memory 128 effects temporary storage. Following the scanning of the last vote indicator position in column 21, optical reader 72 is caused to scan straight ballot vote indicators V209-V215; and as stated above, it is assumed that a straight ballot has been indicated by the operation of indicator V210. When this indicator is scanned, column vote generator 130 generates an output similar to the output of each of the photodiodes of matrix 100, which is fed through gates 132 to each of the memory positions in memory 128 corresponding to each row in that column, except where a gate has been closed as follows.

Row detector 134 detects rows in which votes have been cast by the operation of one of the indicators in columns 15–21, and when a vote in a particular row is detected, an output is provided to gates 132, preventing any entry of an additional vote from column or straight ticket vote generator 130 to that row. Additionally, write-in row detector 124 provides a row blocking signal to gate 132 to block a vote signal from reaching a row location in memory 128 corresponding to a row in which there has been a write-in vote as previously described. Thus, in this manner, a straight ticket vote effects a vote for all candidates in a given column, except where the voter has indicated another choice.

Row detector 124 will typically have an output position or channel for each of the indicators or indicator positions V1-V26 of optical reader 72. Thus, by simple amplitude detection, the presence of a signal by one of these channels provides an indication of a row in which there is a write-in ballot. Similarly, row gates 126 have an electrical channel for each row of indicators on board 10 and through which all signals for that row are routed, and in each channel there exists a row gate or switch which, responsive to an output from row detector 124, closes a row gate, preventing votes from being passed for that row. At this point, buffer memory 128 will have been loaded with votes cast at particular memory locations corresponding to the designation of the vote indicator on board 10.

The problem with certain of the electronic systems thus far proposed is that of assurance that election rules as to the number of votes which may be cast in a given race are observed without the necessity of throwing out a voter's vote in a race where he makes a mistake. For example, where ballots are marked at one time and checked later, which is the case with certain types of electronic systems, if a ballot is improperly marked with respect to a race, vote or votes in that race are simply thrown out. With the present system, this is avoided as follows. First, from the foregoing description, it will be appreciated that buffer memory 128 has been loaded with votes entered by a voter on board 10. Thus, for example, for each memory location there will be stored a coded designation of a vote indicator and a "1" or a "0", indicating a vote or no-vote by that indicator. As described above, these indications would be coded to represent indicators V27-V208. Prior to an election, a memory 140, labelled Race Groups and Indicators Per Group Memory, would be programmed to arrange in a scannable sequence groups of indicators. Each group would correspond to a race for a given office, and the indicators assigned to that group would be those beside the names of candidates running in that race. Thus, in a simple case, there might be 26 races, which would call for 26 groups, G1-G26, requiring 26 memory locations, and at each location there would be a "permissible vote number" stored at a coded location representative of the group designation. Memory 140 would also contain conventional locations scannable between groups to provide any necessary operational instructions to the other units with which it is associated to effect delays between groups scanned to effect or enable operations necessary to check the contents of memory 128. Instruction counter 142, responsive to the order of groups and indicators in groups also stored in memory 140, would thus scan, for example, the indicators corresponding to group 1 in buffer memory 128 (e.g., indicators 27, 53, 79, 105, 131, 157, and 187) to thus provide an output to "One Race Memory" 144 of the "ones" or votes cast in race 1, and memory 144 would include a register to provide a sum of votes cast as an output to comparator-register 146. Thus, for example, assuming that a voter properly casts only one vote in row 23 for the office indicates in column 14 of that row, there would be applied to comparator 146 a 1. At the same time, instruction counter 142 would interrogate memory 148 a "permissible-votes-each-race" memory. This memory would be preprogrammed in terms of groups in the same arrangement as in memory 140, and would contain in memory, 26 coded locations at which the group designation and number of permissible votes for that group would be stored. Thus, in the illustrated case, assuming that in group G1 that one vote was permissible, then memory 148 would provided to comparator 146 a "1" at a time when memory 144 had provided its sum output for that race group to comparator 146. Thus, there being a proper vote, comparator 146 would subtract like group designated outputs of memories 144 and 148, and thus where identical, there would be provided a "0" output indicating a correct vote for a particular group. Instruction counter 142 would step through the balance of the groups and, assuming that all instances of voting were correct, and responsive to a pulse from instruction counter 142 corresponding to the comparison of the last group, an output would be applied from comparator 146 to gate 150 which would then gate through the contents of buffer memory 128, through switch 208, to accumulator 152 where the votes would be stored in discrete registers, one for each voting position V27-V208. Additionally, the vote output of buffer memory 128 would also be supplied to permanent record recorder 154 such as a tape recorder, enabling a permanent record, particularly of value in the event of a power failure or a recount. At the same time, comparator 146 would provide pulse outputs to resettable counter 156 and non-resettable counter 159. Such counters are typically required by statute, non-resettable counter 159 being set to 0 at the same time the equipment is put in usage, and it registers throughout the life of the equipment each time a vote is cast. Resettable counter 156 is reset at the commencement of an election and sealed with a lead car seal. Counter 159 is permanently sealed at the time the equipment is furnished to a purchaser.

In the event that "One Race Memory" 144 receives more votes than permissible for any race group as indicated by memories 144 and 148 to comparator 146, comparator 146 provides an error output to AND gate 153. "Board in" switch 86 provides a second input to AND gate 153, and thus there is provided an output to error indicator 158 which indicates a signal, e.g., by an alarm or light (FIG. 5), the case of an error until board 10 is removed, which would be the case so that a voter could correct his mistake and reinsert the board. The nature of the error may be pointed out by a general instruction prominently displayed on console 74. In the event that it is desired to indicate the race or race group in which a voter has erred, error indicator 158 would include a digital display responsive to the digital output of instruction counter 142 representative of each race group as that group is checked for error, and upon the occurrence of an error, a gating output from comparator 146 would gate on the display to thus display the race designation wherein the error occurred. In order to remove the board, the error signal from comparator 146 is provided as an unlocking signal input to board locking solenoid 88, enabling the board to be removed without being otherwise reset. Additionally, the voting error signal from comparator 146 is supplied to reset generator 160, which then provides a reset output to instruction counter 142 to reset it, to enable the checking process to be repeated when the voter reinserts the voting board or a new voter votes.

When a correct vote is indicated by virtue of an output on comparator line 147, this output is additionally provided to an input of AND gate 162, enabling, upon the operation of board reset switch 163, providing a second input to AND gate 162, the reset of solenoids 164 (FIG. 6) and 166 (FIG. 7) effecting indicator reset and the ejection of write-in votes, respectively. These solenoids include means of indicating completion of their operation by an output, and these respective outputs are provided to AND gate 168 which provides a "completion of vote" output signal to "reset complete" 170, which then provides a board unlocking signal to board locking solenoid 88, unlocking it, and enabling a voting board to be removed for use by the next voter.

Figure 7:
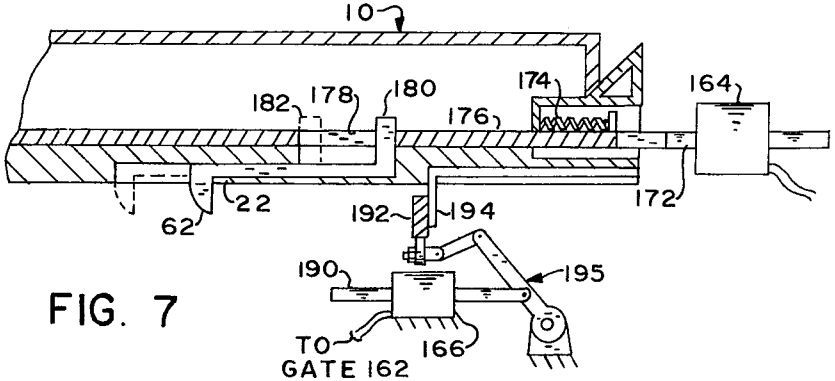
FIG. 7 is a partial sectional view of a voting board taken along lines 7—7 of FIG. 6.

FIGS. 6 and 7 illustrate the mechanisms for resetting the boards and ejection of the boards of write-in ballots. Thus, upon the operation of board reset switch 163, solenoid 164 is operated, moving armature 172 to the left (FIG. 7) against spring 174, and thereby reset plate 176 positioned within board 10. Plate 176 has a slot 178 for each indicator and is adapted to receive a reset arm 180 of an indicator which, when moved to the dashed line position 182, resets indicator 22 to the "no vote" position shown for indicator 22a, as illustrated in FIG. 3. At the same time, an output of switch 163 is applied to write-in solenoid 166, whereupon armature 190 is caused to move to the right, pressing against tab 194 of any write-in ballot 110, causing the ballot to drop down into one of write-in ballot bins 196, the one just under the write-in ballot. In this fashion, the bins are encoded in terms of the office being voted on an properly allocate a vote for the man named on the write-in ballot to that office or race. Alternately, a single bin would be employed, and the voter would simply enter on his write-in ballot the numer appearing beside the office for which he casts a vote. A discrete such number would appear in each row of column 14.

The output of vote accumulator 152 would be made available to a conventional telephone interface device which would supply on demand of an address counter the accumulated votes to a central vote tabulation center for tabulation with votes recorded at other voting precincts or tabulation centers. Display 204, in the form of a light type display or printed display, is also connected to the output of vote accumulator 152, and it may be employed to display the totals in vote accumulator 152 by operation of address counter 203, causing vote totals to be fed to and displayed by display 204. Additionally, display 204 is also connected to receive an output of optical reader 72 in order to enable a test of the system which would be conducted as follows.

A test indicator board with ballots cast for each candidate or proposition is placed in reader 72. Test switch 206, interconnecting reader 72 and display 204, would be closed, and switch 127 between optical reader 72 and buffer memory 128 would be opened. With the test board applied to optical reader 72, fast-slow scan switch 134 would be operated to provide a slow scan rate (e.g., one photodiode scanned per five seconds). As will be noted, a scan signal input is also provided to display 204 through test switch 206 and thereby display 204, typically a cathode array display. The latter would contain a writing circuit to display a number corresponding to the diode address in optical reader 72 which would correspond to a numerical designation for a candidate on the voting board indicator, as explained above. Thus, a readout could be effected which would indicate a candidate coded number (V27-V208) and opposite that a vote (some form of mark) for each of the candidates or propositions on the ballot. This would thus verify that if a vote is cast in any position on the ballot, it will be registered. Additionally, straight ticket voting would be checked by such a test vote by the operation of straight ticket indicators V209-V215. This test would typically be performed at the beginning of a balloting period and at the end of a balloting period, and in this way there would be a clear indication that equipment commenced operating properly and continued operating properly.

Alternately, or additionally, in order to check that the election rules as defined by memories 140 and 148 are proper, switches 206 and 208 would be open, and switch 209 would be closed, and improper votes entered on board 10 with display energized to confirm the casting of the votes as improper, indicator 158 should operate to announce the same, establishing its operability.

FIG. 9 illustrates a modification of the vote reading system illustrated by FIG. 8. Thus, instead of optically reading the position of indicators 22, a position is registered by a matrix of switches or switch indicators 220 mounted on plate 222 in console 74, shown in the operate position in FIG. 9. Coupling tabs 224 would be positioned through openings in plate 222 to switch 220 to provide coupling between indicator knobs 62. The normal position of plate 222 would be below the position shown, it being shown raised by vote read solenoid 226, plate 222 normally supported in a plurality of guide assemblies 228 with solenoid 226 or a plurality of such solenoids being coupled through an appropriate linkage 229 to effect raising and lowering of plate 222. Solenoid 226 would typically be operated by an output from "board in" switch 86 (FIGS. 6 and 10) through "engage switch" or relay 232. By means of switch contacts 234, closable upon the operation of solenoid 226 to raise plate 222, a signal would be provided to read detector 236, which in turn would provide a signal to scanner 120 to, in this case, scan switches 220 to provide an output to buffer memory 128.

Reset of the system requires additionally that comparator 146 supply an open or disengaged signal through line 147 to "engage switch" 232, causing solenoid 226 to lower plate 222. When this is accomplished, relay contacts 234 are opened, and the open or "0" state of these contacts is applied through inverter 240 to AND gate 242, to which is also applied an output of board reset switch 163 and an output from comparator 146. The output of AND gate 242 is then applied as a reset input to gate 163 (FIG. 10), enabling solenoids 164 and 166.

FIG. 10 illustrates the employment of discrete electronic units which may be employed to fabricate a voting system as contemplated by this invention. Alternately, this figure, together with the description, functionally describes information from which a programmer familiar with a general purpose computer can program it to provide the decisions required for signal flow from board reader 72 through to vote accumulator 152 and the performance of the error detection function as described. Such would also be the case for the system illustrated in FIG. 12.

Figure 11:
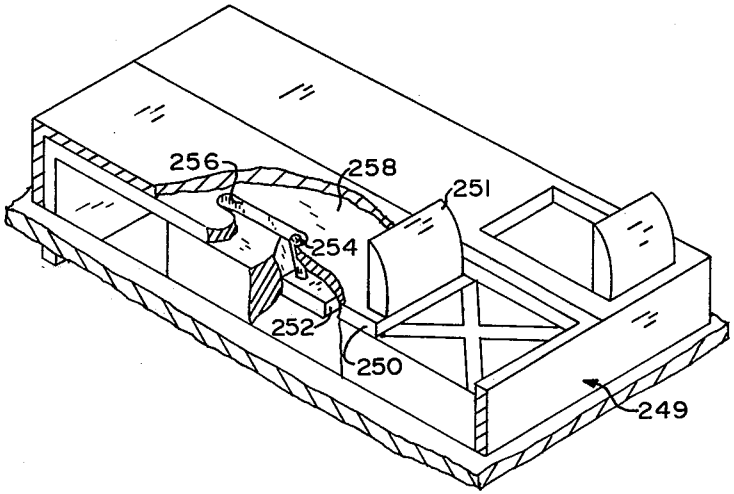
FIG. 11 is a pictorial view, partially broken, illustrating a modified form of a vote indicator which includes an electrical switch for registering votes.
Figure 12:
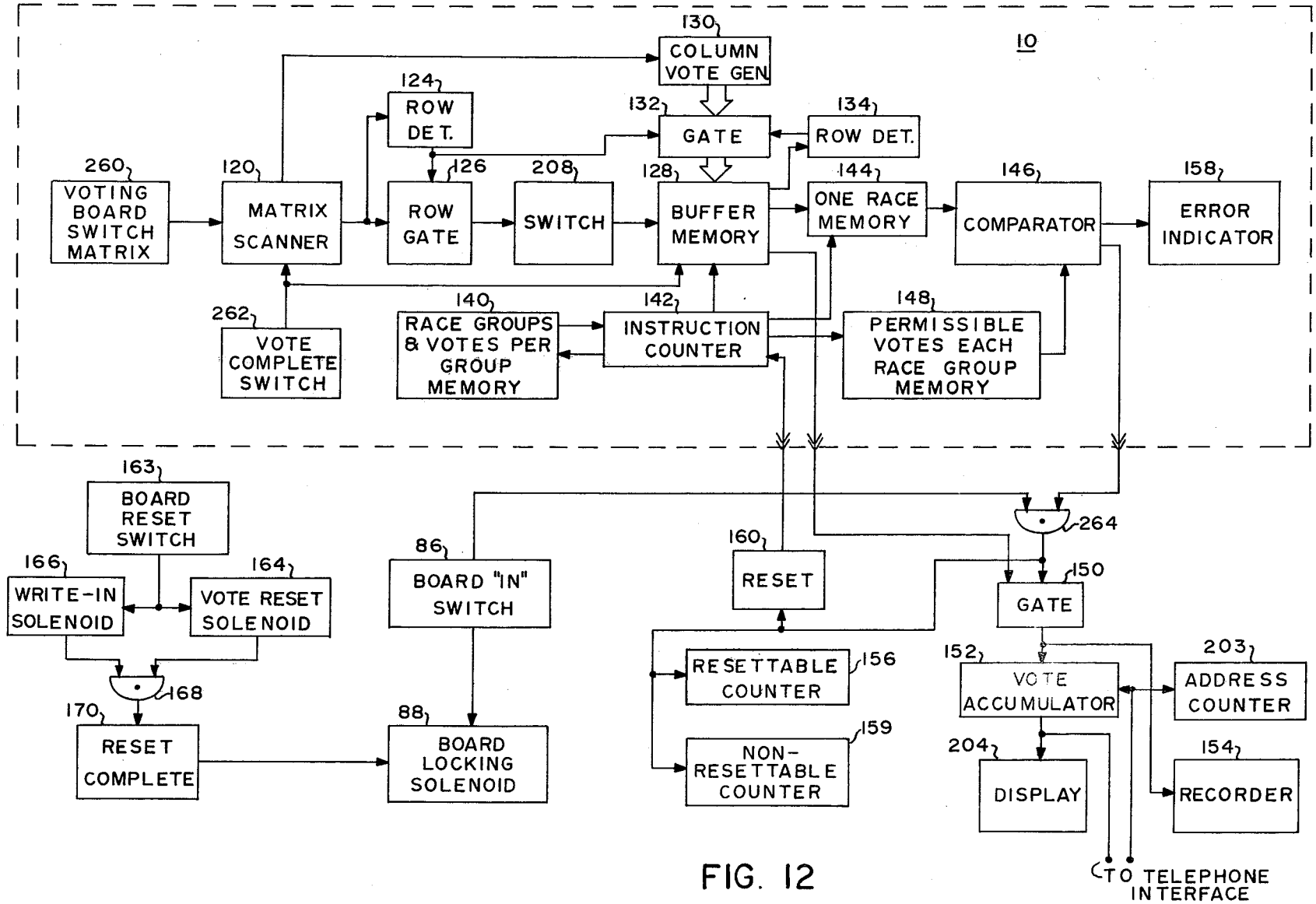
FIG. 12 is an electrical schematic illustration of a modification of the system shown in FIG. 10 wherein a substantial portion of electronic circuitry is contained within a voting board.

FIGS. 11 and 12 illustrate a modification of the invention wherein the electrical system of the invention is split between being housed within voting board 249 and in console 74. Thus, in this case, each of indicators 250 would include a switch, for example, a switch 252 (FIG. 11), having a toggle 254 extending into a slot 256 in slider 258, whereby the switch is operated "on" when the slider is to the left, indicating a vote, and "off" when it is to the right, indicating a non-vote. Thus, voting board matrix 260 (FIG. 12) would consist of a plurality of switches 252 corresponding to the number of indicators, and in order to register a write-in ballot, knob 251 would be positioned, when voting, at a position as shown for knob 251 in FIG. 11. Board 249 contains all circuitry necessary to store in buffer memory 128 a correct vote or indicate an error in voting in error indicator 158. Upon the entering of votes on a board as previously described, the voter would operate vote complete switch 262, whereupon the operation of the circuitry shown in FIG. 12 of board 249 follows that of the circuitry shown in FIG. 10 to the extent indicated by like designated numbers.

"Board in" switch 86 signals that a board is placed in console 74 (FIG. 12) for reading, providing this signal to one input of AND gate 264 (FIG. 12). A second and enabling input to this AND gate is provided from board 249 in the form of a "proper vote" output of comparator 146. This enables the operation of gate 150 to effect loading of votes into vote accumulator 152 and to record or selectively display them as discussed above. Similarly, counters 156 and 159 are operated from the same output of AND gate 264. Further, an output from AND gate 264 is provided to reset 160 which effects a reset of instruction counter 142, enabling it to be ready for the next reading of a voting board. Board reset is accomplished in the same manner as the system illustrated in FIG. 10, with the exception that OR gate 162 is omitted and no unlocking signal is provided to board locking solenoid 88 from indicator 158 since error indication occurs before the insertion of a board in console 74.

In the basic embodiment of this invention, all electronic circuitry is eliminated in the voting board itself, and at the same time, vote indications are entered in a foolproof and fraud-proof manner. The vote indicating board is relatively simple in construction and thus more economical to produce than complete discrete voting machines, whether they be either electronic or mechanical. There are no punch cards which may be incorrectly punched or paper ballots other than a relatively small number of write-in ballots which must be handled by hand, and thus there is in reality no real chance of fraud or mistake in the counting process. The voter is not committed to vote until he elects to be committed by entering the voting board into the voting console. A second basic embodiment of the invention incorporates a portion of the system into the voting board and offers, at some additional expense, the same basic safeguards and conveniences as described as the other embodiment.

Although the employment of a single board having all of the races in an election on it is illustrated and described, it is to be appreciated that two boards may be employed, each covering a part of the total ballot of an election. In such case, each board would have a discrete coding member (e.g., a particular indentation in a board) which would be decoded by the reading console to effect necessary memory selections (e.g., from two each of the "permissible votes each race memory" and "race groups and votes per group memory"), and which would include coding to correctly designate and record permissible votes from each board. Dual board capability would appear desirable to most conveniently take care of small and large ballot elections and to provide separate party ballots for primary elections.

Having thus described our invention, what is claimed is:

1. A voting system comprising:

a portable and hand-held vote entering means comprising:

display means including a plurality of spaced rows and columns wherein a matrix of areas are formed in which discrete ballot data may be inserted, and selection means including a plurality of hand-operated designators associated with each said area, and wherein:

said designators arranged in a plurality of columns and rows each comprise a movable member which is shiftable from a first, reference, "no" vote representative position to a second, selected, "yes" vote representative position, each said designator includes a viewable region which displays a first light responsive state when a said designator is in a "no" position and a contrasting and different and second light responsive state when in a "yes" position, and vote reading means comprising optical means for viewing said viewable region of each said designator and providing a discrete output when a discrete vote designator is in a said "yes" position;

vote processing means, separate from said vote entering means, including receptacle means adapted to receive a said vote entering means including vote accumulating means responsive to a said vote entering means and to said output signals from said vote reading means for registering and providing discrete totals of votes cast by discrete said designators from a plurality of instances of engagement of said vote entering means with said receptacle means;

impermissible vote detection means coupled between said vote reading means and said vote accumulating means, and responsive to the state of said designators after an instance of use by a voter for signalling an error in the event that more than a selected number of said designators of a selected group of designators is moved to a "yes" position; and reset means housed by said vote processing means for resetting all said designators to a "no" state.

2. A voting system as set forth in claim 1 wherein each said vote designator includes a slidable cover and underlying surface which is selectively covered and uncovered by a said sliding cover, and wherein a portion of said sliding member which covers said underlying portion is of said first light responsive state, and the underlying portion is of a second light responsive state, whereby when said sliding member is in a "closed" position, a "no" state would be sensed by said reading means, and when said sliding member uncovers said underlying portion, said reading means senses a "yes" state.

3. A voting system comprising:

a portable and hand-held vote entering means comprising:

display means including a plurality of spaced rows and columns wherein a matrix of areas are formed in which discrete ballot data may be inserted, and selection means including a plurality of hand-operated designators associated with each said area, and each having a "yes" and a "no" vote position;

vote reading means responsive to the state of said designators for providing discrete output signals indicative of a "yes" vote;

vote processing means, separate from said vote entering means, including receptacle means adapted to receive a said vote entering means, and including vote accumulating means responsive to a said vote entering means and to said output signals from said vote reading means for registering and providing discrete totals of votes cast by discrete said designators from a plurality of instances of engagement of said vote entering means with said receptacle means;

impermissible vote detection means coupled between said vote reading means and said vote accumulating means, and responsive to the state of said designators after an instance of use by a voter for signalling an error in the event that more than a selected number of said designator of a selected group of designators is moved to a "yes" position;

reset means housed by said vote processing means for resetting all said designators to a "no" state;

means for enabling a write-in ballot comprising:

second receptacle means comprising a plurality of receptacles in a discrete column separate from said first-named columns, there being a said second receptacle in each row of said areas on said display means, and wherein all candidates for a particular race are indicated on a single row;

disabling means responsive to a card positioned in a selected one of said second receptacles bearing a write-in vote for preventing the reading of a "yes" state of a designator in that row; and third receptacle means and receptacle clearing means coordinately operative with said reset means for clearing said second receptacle of said card and including means for moving said card into said third receptacle;

whereby a write-in vote may be cast by placing a card bearing a write-in candidate's name in a said first receptacle, whereby any other selection in that row is prevented, and whereby the write-in ballot is placed in a receptacle.

4. A voting system as set forth in claim 3 wherein:

each vote designator includes means for exhibiting a first electrical output when positioned for a "no" state, and a second electrical output when positioned for a "yes" state;

said vote entering means includes said vote reading means and said impermissible vote detection means, and said impermissible vote detection means comprises:

a plurality of logic means, each being connected to said electrical outputs of a selected group of said designators for providing an error output whenever more than a selected number of said group of said designators exhibits a "yes" state, and signal means responsive to said logic means for signalling the occurrence of an error state, whereby a voter would be immediately informed of an error in the event of voting for more than one candidate of a group in a single race.

* * * * *